US008905787B2

(12) United States Patent
Blakborn et al.

(10) Patent No.: US 8,905,787 B2
(45) Date of Patent: Dec. 9, 2014

(54) PLUG-TYPE CONNECTOR

(75) Inventors: Willem Blakborn, Inzell (DE); Gregor Reiner, Traunstein (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 70 days.

(21) Appl. No.: 13/807,173

(22) PCT Filed: Jun. 1, 2011

(86) PCT No.: PCT/EP2011/002728

§ 371 (c)(1),
(2), (4) Date: Jan. 28, 2013

(87) PCT Pub. No.: WO2012/000596

PCT Pub. Date: Jan. 5, 2012

(65) Prior Publication Data

US 2013/0149885 A1 Jun. 13, 2013

(30) Foreign Application Priority Data

Jun. 28, 2010 (DE) ..... 20 2010 009 599 U

(51) Int. Cl.

| | |
|---|---|
| ***H01R 13/60*** | (2006.01) |
| ***H01R 13/62*** | (2006.01) |
| ***H01R 9/05*** | (2006.01) |
| ***H01R 13/64*** | (2006.01) |
| ***H01R 13/648*** | (2006.01) |
| ***H01R 13/502*** | (2006.01) |

(52) U.S. Cl.

CPC ..... *H01R 13/62* (2013.01); *H01R 9/05* (2013.01); *H01R 13/64* (2013.01); *H01R 13/648* (2013.01); *H01R 13/502* (2013.01)

USPC ..... 439/607.41

(58) Field of Classification Search

USPC ..... 439/607.41–607.52, 98, 99, 578, 580, 439/582–585

See application file for complete search history.

(56) References Cited

U.S. PATENT DOCUMENTS

| | | | | |
|---|---|---|---|---|
| 5,011,426 | A | 4/1991 | Colleran | |
| 5,145,412 | A | 9/1992 | Tan | |
| 5,453,025 | A | 9/1995 | Wilson | |
| 5,489,222 | A | 2/1996 | Moyer | |
| 5,618,190 | A * | 4/1997 | Masuda et al. | 439/98 |
| 5,645,450 | A * | 7/1997 | Yamada et al. | 439/585 |
| 5,833,495 | A * | 11/1998 | Ito | 439/607.48 |
| 5,911,599 | A * | 6/1999 | Masuda | 439/607.58 |
| 5,928,032 | A * | 7/1999 | Dreesen | 439/578 |
| 5,975,950 | A * | 11/1999 | Yamaguchi | 439/585 |
| 6,083,048 | A * | 7/2000 | Yamaguchi | 439/607.05 |
| 6,099,352 | A * | 8/2000 | Yamaguchi | 439/607.5 |

(Continued)

*Primary Examiner* — Ross Gushi

(74) *Attorney, Agent, or Firm* — DeLio, Peterson & Curcio, LLC; Robert Curcio

(57) ABSTRACT

A plug-in connector having an outer conductor electrically and mechanically connected to an outer conductor of a cable and forming an electromagnetic screen for the plug-in connector, and having an insulating part securing at least one inner conductor part in a predetermined position relative to the outer conductor part, and having a housing in which the outer conductor part and the insulating part are arranged. An anti-rotation lock is connected to the housing to be secure in rotation therewith and which fits through the outer conductor part and into the insulating part such that the insulating part and the housing are connected together by the anti-rotation lock to be secure in rotation with one another.

15 Claims, 2 Drawing Sheets

(56) References Cited

U.S. PATENT DOCUMENTS

| | | | | |
|---|---|---|---|---|
| 6,257,931 | B1 * | 7/2001 | Sakurai et al. | 439/607.5 |
| 6,572,405 | B2 * | 6/2003 | Lin et al. | 439/578 |
| 6,932,645 | B2 * | 8/2005 | Kao | 439/578 |
| 7,044,786 | B2 * | 5/2006 | Nimura | 439/587 |
| 7,081,016 | B2 * | 7/2006 | Tateno | 439/585 |
| 7,198,507 | B2 * | 4/2007 | Tusini | 439/483 |
| 7,425,152 | B2 * | 9/2008 | Hardt et al. | 439/578 |
| 7,425,153 | B1 * | 9/2008 | Miller | 439/578 |
| 7,500,878 | B2 * | 3/2009 | Akino | 439/607.41 |
| 7,503,776 | B1 * | 3/2009 | Pavlovic et al. | 439/98 |
| 7,563,134 | B2 * | 7/2009 | Kim | 439/578 |
| 7,597,563 | B2 * | 10/2009 | Shinkawa et al. | 439/98 |
| 7,632,121 | B2 * | 12/2009 | Gonzales et al. | 439/188 |
| 7,635,283 | B1 | 12/2009 | Islam | |
| 7,731,548 | B2 * | 6/2010 | Yoshida | 439/752.5 |
| 8,466,378 | B1 * | 6/2013 | Gretz | 174/659 |
| 2002/0019167 | A1 * | 2/2002 | Koide | 439/585 |
| 2002/0160657 | A1 * | 10/2002 | Boillot | 439/578 |
| 2002/0177358 | A1 * | 11/2002 | Baffert | 439/582 |
| 2003/0003805 | A1 * | 1/2003 | Yamamoto | 439/610 |
| 2003/0040219 | A1 * | 2/2003 | Lin et al. | 439/578 |
| 2004/0152359 | A1 * | 8/2004 | Benham | 439/610 |
| 2005/0042920 | A1 * | 2/2005 | Poiraud | 439/582 |
| 2005/0142938 | A1 * | 6/2005 | Kao | 439/578 |
| 2006/0264100 | A1 * | 11/2006 | Peng | 439/580 |
| 2008/0032556 | A1 * | 2/2008 | Schreier | 439/610 |
| 2008/0124972 | A1 * | 5/2008 | Kobayashi et al. | 439/585 |
| 2008/0160836 | A1 | 7/2008 | Chen | |
| 2008/0207057 | A1 * | 8/2008 | Akino | 439/610 |
| 2008/0293295 | A1 * | 11/2008 | Chen et al. | 439/578 |
| 2009/0004916 | A1 * | 1/2009 | Miyoshi et al. | 439/610 |
| 2009/0011637 | A1 * | 1/2009 | Kim | 439/578 |
| 2009/0035993 | A1 * | 2/2009 | Okayasu | 439/610 |
| 2009/0156057 | A1 * | 6/2009 | Strickland, Jr. | 439/582 |
| 2009/0191750 | A1 * | 7/2009 | Kadar-Kallen et al. | 439/578 |
| 2009/0291588 | A1 * | 11/2009 | Ikumi et al. | 439/578 |
| 2010/0210140 | A1 * | 8/2010 | Metral et al. | 439/607.41 |
| 2011/0034072 | A1 * | 2/2011 | Feldman et al. | 439/578 |
| 2013/0029522 | A1 * | 1/2013 | Holliday et al. | 439/584 |
| 2013/0122732 | A1 * | 5/2013 | Blakborn et al. | 439/357 |

* cited by examiner

PLUG-TYPE CONNECTOR

BACKGROUND OF THE INVENTION

1. Field of the Invention

The present invention relates to a plug-in connector, having an outer conductor part which is designed to be connected electrically and mechanically to an outer conductor of a cable and which forms an electromagnetic screen for the plug-in connector, having an insulating part which is designed to hold at least one inner conductor part in a predetermined position relative to the outer conductor part.

2. Description of Related Art

Known from U.S. Pat. No. 5,489,222 is a mini plug-in connector having a contact which is secured against rotation. The connector has an outer conductor part, an insulating part and an electrical contact. The outer conductor part is designed to be connected electrically and mechanically to a co-axial cable and has ribs on its interior surface. The inside diameter of the outer conductor part is slightly larger than the outside diameter of the insulating part and four ribs project inward radially from the interior surface of the outer conductor part. These four ribs are a press fit with the inner conductor part, thus preventing the insulating part from rotating relative to the outer conductor part.

Known from U.S. Pat. No. 5,145,412 is a BNC plug-in angle connector which has a housing for soldering onto a circuit board, in which on the housing is arranged an outer conductor part. Arranged in the outer conductor part is an insulating part or insulator which holds an inner conductor. The outer conductor part has a circumferential slot which is formed at a reduced diameter end of the outer conductor part. Formed within this circumferential slot are diametrically opposed protrusions. A C-shaped spring metal band having a pair of apertures is inset into the circumferential slot and the slot thus prevents the spring metal band from axial movement. The apertures in the spring metal band receive the protrusions of the outer conductor part to fix the band within the slot and to achieve an anti-rotation function within the slot. This produces anti-rotation locking for the spring metal band relative to the outer conductor part. Anti-rotation locking is also obtained for the outer conductor part relative to the housing, by means of co-operation between a flat surface on the outer conductor part and a corresponding flat interior surface in the housing. However, no anti-rotation locking is provided for the insulating part.

Known from U.S. Pat. No. 5,011,426 is a plug-in connector assembly having a male connector which has a plastics housing and a bush. The plastics housing has anti-rotation lugs. What is not provided however is an outer conductor part which is designed to be connected electrically and mechanically to an outer conductor of a cable.

Known from U.S. Pat. No. 5,453,025 is an electrical plug-in connector having an outer conductor part, an insulating part or insulator which is arranged in an axial bore in the outer conductor part, and an inner conductor which is arranged in an axial bore in the insulating part. Also provided is anti-rotation locking for the inner conductor relative to the insulating part and anti-rotation locking for the insulating part relative to the outer conductor part. Arranged on the inner side of the outer conductor part are protrusions which dig into the softer material of the insulating part as the insulating part is inserted. There is no housing provided in which the outer conductor part and the insulating part are arranged.

Known from U.S. Pat. No. 7,635,283 B1 is a plug-in connector for a co-axial cable, which co-axial cable has an inner conductor, an outer conductor and a dielectric arranged there between. The plug-in connector has an internally threaded back nut which receives an externally threaded rearward end of a connector housing. The connector housing has a cavity to receive an electrically conductive compressible ring. The ring presses the outer conductor of the co-axial cable against a ramp-shaped section of the wall of the nut as the connector housing and the nut are screwed together. This pressure-applying function of the ring ensures that there is an electrically conductive connection between the outer conductor of the co-axial cable and the ramp-shaped section of the wall by providing a constant contact-making force. What is more, the ring also provides anti-rotation locking for the co-axial cable relative to the connector housing and to the nut. No anti-rotation locking is provided for the insulating part of the connector.

Known from US 2008/0160836 A1 is a cable connector plug having a plurality of contacts arranged co-axially to one another, between each pair of which an insulator is arranged. On their inner surfaces adjacent respective ones of the insulators, two of the contacts have anti-rotation members which take the form of internal teeth or internal screw threads. The internal teeth press into respective ones of the insulators. This prevents these two contacts from moving in rotation relative to an innermost contact when the plug is inserted into a matching mating connector and is turned. The anti-rotation member is formed on inner surfaces of conductor parts and does not therefore fit through an outer conductor part. What is more, no housing is provided in which the contacts and insulators are arranged. Furthermore, none of the contacts is so designed that it is able to form an electromagnetic screen for the connector plug.

BRIEF SUMMARY OF THE INVENTION

The object underlying the invention is to improve a plug-in connector of the above kind in respect of its assembly and reliable operation.

This object is achieved in accordance with the invention by a plug-in connector of the above kind which has the features characterized in the claims.

The above and other objects, which will be apparent to those skilled in the art, are achieved in the present invention which is directed to a plug-in connector comprising an outer conductor part connected electrically and mechanically to an outer conductor of a cable forming an electromagnetic screen for the plug-in connector, an insulating part holding at least one inner conductor part in a predetermined position relative to the outer conductor part, a housing securing the outer conductor part and the insulating part, and an anti-rotation lock connected to the housing to be secure in rotation therewith and fitting through the outer conductor part and into the insulating part such that the insulating part and the housing are connected together by the anti-rotation lock to be secure in rotation with one another.

The anti-rotation lock forms a ring which fits round the outer circumference of the outer conductor part and which has a pin projecting inwards radially fitting through the outer conductor part and into the insulating part.

The pin fits through an aperture in the outer conductor part which is so designed that any movement of the ring in rotation relative to the outer conductor part is blocked.

The pin also fits into a recess in the insulating part which is so designed that any movement of the insulating part in rotation relative to the ring is blocked.

The ring may comprise a resilient material.

A groove may be formed in the outer circumference of the outer conductor part extending round in a loop circumferentially in which the ring is arranged.

The anti-rotation lock may be integral with the housing.

At least one inner conductor part may be connected electrically and mechanically to an inner conductor of a an RF cable or a power cable.

BRIEF DESCRIPTION OF THE DRAWINGS

The invention will be explained in detail below by reference to the drawings. In the drawings.

DESCRIPTION OF THE PREFERRED EMBODIMENT(S)

In describing the preferred embodiment of the present invention, reference will be made herein to FIGS. 1-2 of the drawings in which like numerals refer to like features of the invention.

In a plug-in connector of the above kind, provision is made in accordance with the invention for a housing to be provided in which the outer conductor part and the insulating part are arranged, an anti-rotation lock being provided which is connected to the housing to be secure in rotation therewith and which fits through the outer conductor part and into the insulating part in such a way that the insulating part and the housing are connected together by the anti-rotation lock to be secure in rotation with one another.

This has the advantage that, with regard to the anti-rotation locking of the insulating part within the plug-in connector, a chain of tolerances is shortened because the outer conductor part is bypassed as far as the anti-rotation locking of the insulating part is concerned.

An anti-rotation lock which is particularly reliable in operation and particularly easy to fit is obtained by giving the anti-rotation lock the form of a ring, and in particular a C-ring, which fits round the outer circumference of the outer conductor part and which has a pin, which pin projects inwards radially and fits through the outer conductor part and into the insulating part.

A particularly reliable mechanical connection is obtained between the ring and the outer conductor part by having the pin fit through an aperture in the outer conductor part which is so designed that any movement of the ring in rotation relative to the outer conductor part is blocked.

A particularly reliable mechanical connection is obtained between the ring and the inner conductor part by having the pin fit into a recess in the insulating part which is so designed that any movement of the insulating part in rotation relative to the ring is blocked.

Easy fitting and removal of the anti-rotation lock to and from the housing are achieved by forming the ring from a resilient material.

Additional axial locking of the ring relative to the housing is achieved by forming in the outer circumference of the outer conductor part a groove extending round in a loop circumferentially in which the ring is arranged.

Automatic fitting of the anti-rotation lock as the housing is fitted is achieved by forming the anti-rotation lock in one piece with the housing.

A plug-in connector for an cable having one or more inner conductors is easily obtained by providing at least one inner conductor part which is designed to be connected electrically and mechanically to an inner conductor of a cable and in particular of an RF cable or a power cable.

Figure 1:
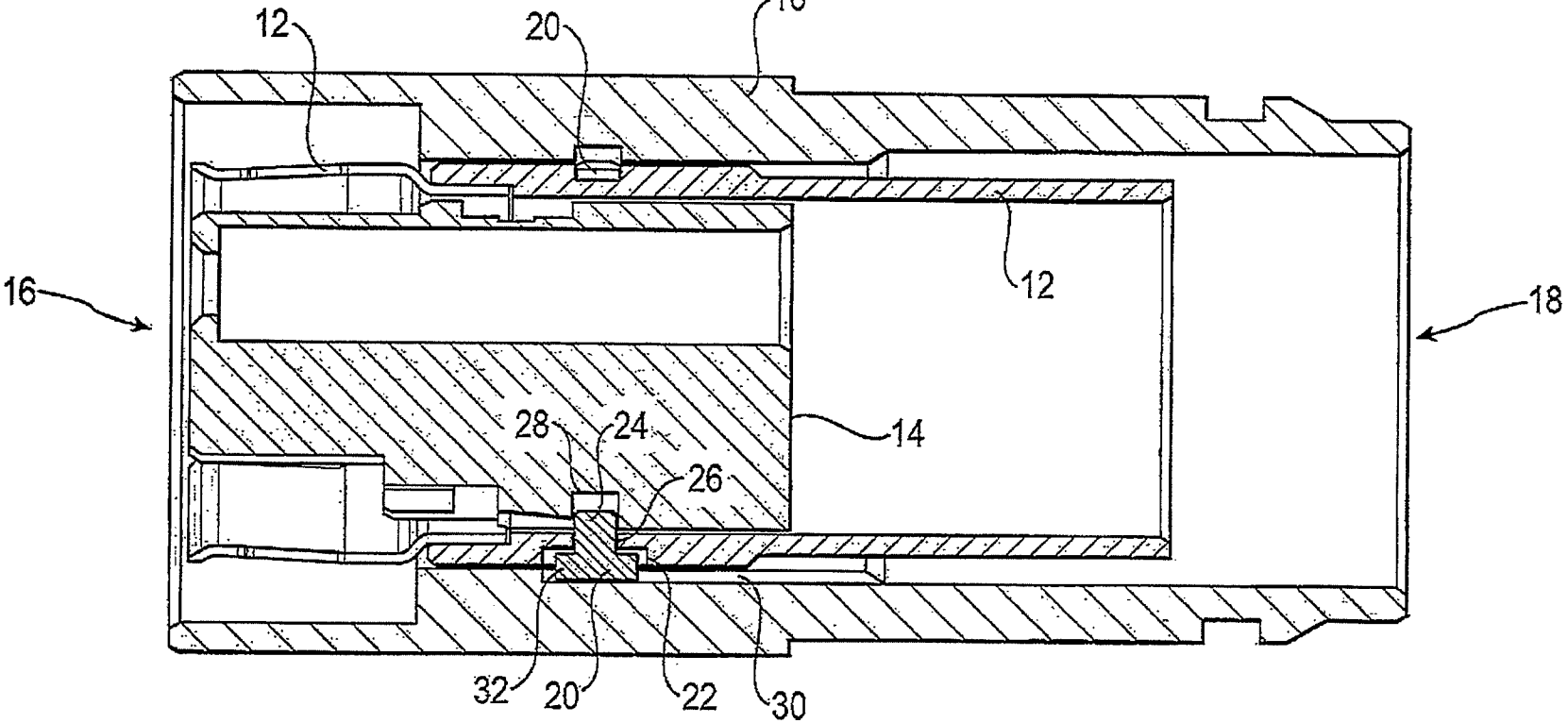
FIG. 1 is a longitudinal section through a preferred embodiment of plug-in connector according to the invention.

The preferred embodiment of plug-in connector according to the invention which is shown in FIG. 1 comprises a housing 10, an outer conductor part 12 which is arranged inside the housing 10 radially, and an insulating part 14 which is arranged inside the outer conductor part radially. The housing 10, outer conductor part 12 and insulating part 14 are arranged co-axially to one another. The plug-in connector has an insertion end 16 for connection by insertion to a complementary connector (not shown), and a cable end 18 for electrical and mechanical connection to a cable (not shown) which has an outer conductor forming an electromagnetic screen and at least one inner conductor. The outer conductor part 12 is designed to be connected electrically and mechanically to the outer conductor (not shown) of the cable. To receive at least one inner conductor part (not shown), the insulating part 14 is so designed that said insulating part 14 holds the inner conductor part or parts in a predetermined position within the outer conductor part 12 and insulates it or them electrically from the outer conductor part 12. The insulating part 14 is made for example from a dielectric material, with its geometrical dimensions and the dielectric material being so selected that the plug-in connector has a predetermined impedance. In this way the plug-in connector according to the invention can also be used to transmit RF signals.

Arranged between the housing 10 and the outer conductor part 12 is an anti-rotation lock 20 in the form of a C-ring, this C-ring 20 being aligned substantially parallel to a plane perpendicular to a longitudinal axis of the housing 10. The anti-rotation lock 20 takes the form of an arc of a circle or in other words is a ring which has a break at one point. The anti-rotation lock 20 is for example formed from a resilient material, the C-ring 20 thus being able to be bent inwards or outwards radially and then automatically returning to its starting position under the prompting of resilient force. This enables the C-ring 20 to be fitted onto the outside of the outer conductor part 12 after the manufacture of the latter. For this purpose, the C-ring 20 is for example enlarged radially and fed along the outer conductor part 12 in the axial direction until a predetermined point on the outer circumference of the outer conductor part 12 is reached at which for example a groove 22 to receive the C-ring 20 is formed. At this point, the stress on the C-ring 20 is relaxed again and it thus comes to rest in its starting position in the groove 22 in the outer circumference of the outer conductor part 12. The anti-rotation lock 20 serves to fix the insulating part 14 to be secure in rotation within the housing 10, which it does by means of a pin 24 which projects radially inwards from the anti-rotation lock 20, as will be explained in detail below by reference to FIG. 2.

Figure 2:
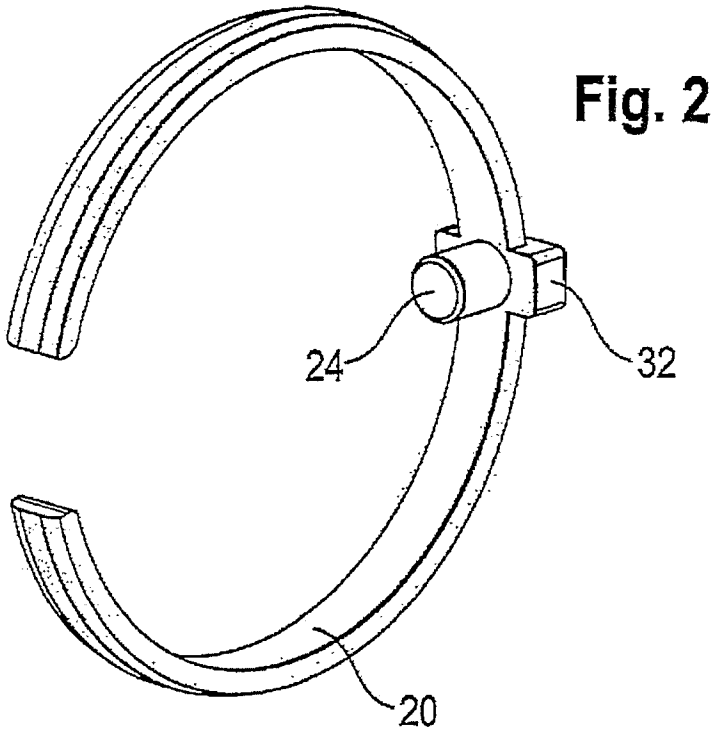
FIG. 2 is a perspective view of a preferred embodiment of anti-rotation lock in the form of a C-ring.

FIG. 2 shows an anti-rotation lock 20 in the form of the C-ring having the pin 24. In the region of the pin 24, the C-ring has a cuboid widening 32 which fits into a corresponding recess in the inner circumference of the housing 10. In this way, the C-ring 20 is connected to the housing 10 mechanically to be secure in rotation therewith. As can be seen from FIG. 1, the recess in the inner circumference of the housing 10 takes the form of a groove 30 extending in the axial direction whose width in the circumferential direction is so selected that, although the cuboid formation on the C-ring 20 fits into it, the C-ring 20 is prevented from moving in rotation relative to the housing 10 as a result of the cuboid formation on the C-ring 20 butting against inside walls of the groove 30.

As can be seen from FIG. 1, the pin 24 fits through a through-opening 26 in the outer conductor part 12 and into a groove 28 in the insulating part 14, the C-ring 20 thus also being connected to the insulating part 14 to be secure in rotation therewith. The insulating part 14 is thereby connected to the housing 10 to be secure in rotation therewith, the outer conductor part 12 not performing any function in making this connection between the housing 10 and the insulating part 14 to be secure in rotation with one another. In other words, the outer conductor part 12 is no longer part of the chain of tolerances for the anti-rotation locking of the insulating part 14 in the housing 10.

The anti-rotation lock 20 ensures a predetermined orientation relative to the housing 10 for the inner conductor parts held in the insulating part 14. This ensures that, when the plug-in connector according to the invention is inserted in a complementary connector, a given inner conductor part of the plug-in connector according to the invention will make electrical and mechanical contact with a given, desired, inner conductor part of the complementary connector. In other words, the arrangement of the inner conductor parts in the plug-in connector according to the invention will correspond to the arrangement of the inner conductor parts in the complementary connector.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug-in connector comprising an outer conductor part connected electrically and mechanically to an outer conductor of a cable forming an electromagnetic screen for the plug-in connector, an insulating part holding at least one inner conductor part in a predetermined position relative to the outer conductor part, a housing securing the outer conductor part and the insulating part, and an anti-rotation lock connected to the housing to be secure in rotation therewith and fitting through the outer conductor part and into the insulating part such that the insulating part and the housing are connected together by the anti-rotation lock to be secure in rotation with one another.

2. The plug-in connector of claim 1 wherein at least one inner conductor part is connected electrically and mechanically to an inner conductor of an RF cable or a power cable.

3. The plug-in connector of claim 1, wherein the anti-rotation lock includes a C-ring.

4. The plug-in connector of claim 1 wherein the anti-rotation lock forms a ring which fits round the outer circumference of the outer conductor part and which has a pin projecting inwards radially fitting through the outer conductor part and into the insulating part.

5. The plug-in connector of claim 4 wherein the pin fits through an aperture in the outer conductor part which is so designed that any movement of the ring in rotation relative to the outer conductor part is blocked.

6. The plug-in connector of claim 5 wherein the pin fits into a recess in the insulating part which is so designed that any movement of the insulating part in rotation relative to the ring is blocked.

7. The plug-in connector of claim 5, wherein the anti-rotation lock includes a C-ring.

8. The plug-in connector of claim 4 wherein the pin fits into a recess in the insulating part which is so designed that any movement of the insulating part in rotation relative to the ring is blocked.

9. The plug-in connector of claim 8 wherein the ring comprises a resilient material.

10. The plug-in connector of claim 8, wherein the anti-rotation lock includes a C-ring.

11. The plug-in connector of claim 4 wherein the ring comprises a resilient material.

12. The plug-in connector of claim 11 including a groove formed in the outer circumference of the outer conductor part extending round in a loop circumferentially in which the ring is arranged.

13. The plug-in connector of claim 4 including a groove formed in the outer circumference of the outer conductor part extending round in a loop circumferentially in which the ring is arranged.

14. The plug-in connector of claim 4 including a groove formed in the outer circumference of the outer conductor part extending round in a loop circumferentially in which the ring is arranged.

15. The plug-in connector of claim 4, wherein the anti-rotation lock includes a C-ring.

* * * * *